US010060225B2

(12) United States Patent
Wolf et al.

(10) Patent No.: US 10,060,225 B2
(45) Date of Patent: Aug. 28, 2018

(54) MULTILATERAL Y-BLOCK SYSTEM

(71) Applicant: Schlumberger Technology Corporation, Sugar Land, TX (US)

(72) Inventors: John C. Wolf, Houston, TX (US); Luis A. Gonzalez, Houston, TX (US); Barton Sponchia, Cypress, TX (US); Andrew Brian Huang, The Woodlands, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 589 days.

(21) Appl. No.: 14/434,511

(22) PCT Filed: Oct. 10, 2013

(86) PCT No.: PCT/US2013/064265
§ 371 (c)(1),
(2) Date: Apr. 9, 2015

(87) PCT Pub. No.: WO2014/059098
PCT Pub. Date: Apr. 17, 2014

(65) Prior Publication Data

US 2015/0233190 A1 Aug. 20, 2015

Related U.S. Application Data

(60) Provisional application No. 61/713,374, filed on Oct. 12, 2012.

(51) Int. Cl.

| | |
|---|---|
| ***E21B 17/18*** | (2006.01) |
| ***E21B 41/00*** | (2006.01) |
| ***E21B 17/20*** | (2006.01) |

(52) U.S. Cl.
CPC ..... *E21B 41/0035* (2013.01); *E21B 17/18* (2013.01); *E21B 17/20* (2013.01)

(58) Field of Classification Search
CPC ..... E21B 17/18; E21B 17/20; E21B 17/02; E21B 17/023; E21B 17/026; E21B 41/0035
See application file for complete search history.

(56) References Cited

U.S. PATENT DOCUMENTS 6,158,513 A 12/2000 Nistor et al.
6,789,627 B2 9/2004 Leismer
(Continued)

FOREIGN PATENT DOCUMENTS

RU 2381351 C1 2/2010
RU 2436925 C2 12/2011
(Continued)

OTHER PUBLICATIONS

International Search Report for International Application No. PCT/US2013/064265 dated Jan. 17, 2014.
(Continued)

*Primary Examiner* — Brad Harcourt

(57) ABSTRACT

A technique utilizes a Y-block which is coupled with a lateral tubing string and a main tubing string. The Y-block comprises features which facilitate service and/or production operations. In well applications, the Y-block may comprise a pressure housing and a recessed bypass slot disposed along an exterior of the Y-block. A control line is positioned in the recessed bypass slot to facilitate control functions along the lateral tubing string. The recessed bypass slot enables routing of a control line without forming a splice along the control line. In other applications, the Y-block may utilize additional or other features which facilitate the desired operations.

19 Claims, 7 Drawing Sheets

(56) References Cited

U.S. PATENT DOCUMENTS

| | | | | |
|---|---|---|---|---|
| 2001/0025710 | A1 | 10/2001 | Ohmer et al. | |
| 2001/0045283 | A1 | 11/2001 | Leismer | |
| 2003/0159827 | A1 | 8/2003 | Steele | |
| 2010/0170677 | A1 | 7/2010 | Ingraham | |
| 2010/0276158 | A1 | 11/2010 | Ingraham | |
| 2011/0139458 | A1 | 6/2011 | Shafiq et al. | |
| 2011/0303419 | A1* | 12/2011 | Maier | E21B 17/026 166/373 |

FOREIGN PATENT DOCUMENTS

| | | | |
|---|---|---|---|
| RU | 2449107 | C2 | 4/2012 |
| SU | 829882 | A | 5/1981 |
| WO | 2014059098 | A1 | 4/2014 |

OTHER PUBLICATIONS

Office Action issued in related RU application 2015117427 dated May 19, 2016, 8 pages.

* cited by examiner

MULTILATERAL Y-BLOCK SYSTEM

BACKGROUND

Multilateral wells have become more common in the oil and gas industry. In multilateral well applications, multilateral completions are formed by joining tubulars and completion related equipment. The tubulars and other equipment are used in constructing tubing strings which extend along a main bore and lateral bores of the multilateral well. The tubing strings are useful in a variety of service and production procedures. In many applications, difficulties arise in providing control, e.g. electrical or hydraulic control signals, to equipment in the lateral bores. Similarly, difficulties can arise in enabling selective intervention into main and lateral bores.

SUMMARY

In general, a system and methodology are provided for utilizing a Y-block. The Y-block is coupled with a lateral tubing string and a main tubing string and comprises features which facilitate service and/or production operations. In well applications, for example, the Y-block may comprise a pressure housing and a recessed bypass slot disposed along an exterior of the Y-block. A control line is positioned in the recessed bypass slot to facilitate control functions along the lateral tubing string. The recessed bypass slot enables routing of a control line without forming a splice along the control line. In other applications, the Y-block may utilize additional or other features which facilitate the desired operations.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
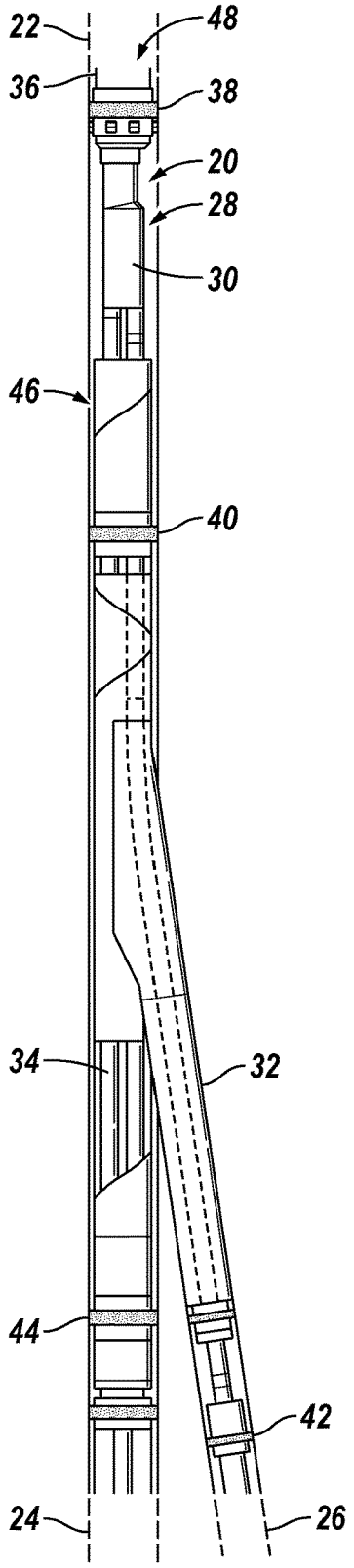
FIG. 1 is an illustration of a multilateral completion system deployed in a wellbore and comprising an example of a Y-block, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology related to utilizing a Y-block in a tubing structure. The Y-block has two legs coupled with a combined leg to form a Y-shaped structure. In a variety of well applications, the Y-block is oriented in a wellbore in an inverted Y position in which the two legs of the Y-block extend downhole. However, the Y-block also may be used in non-well applications to facilitate operations through a variety of joined tubing strings.

In well applications, the Y-block is coupled with a lateral tubing string and a main tubing string and comprises features which facilitate service and/or production operations. For example, the Y-block may comprise a pressure housing and a recessed bypass slot disposed along an exterior of the Y-block to accommodate a control line or a plurality of control lines. A control line (or control lines) may be positioned in the recessed bypass slot and routed past the Y-block into the lateral bore to facilitate control functions along the lateral tubing string. The recessed bypass slot enables routing of a control line into the lateral bore without forming a splice along the control line. The splice-free control line reduces the potential for leakage, corrosion, and control line damage which can occur at splice points. The Y-block also may utilize additional or other features which facilitate desired operations, such as selective interventions and separation of production flows from the lateral bore and the main bore.

The Y-block may be used in a variety of well systems. In a multilateral completion, for example, the Y-block may be used to complete a multilateral junction to a TAML Level 5 rating while enabling a control line(s), e.g. a cable, to bypass the Y-block for supporting an advanced intelligent completion in a lateral bore. In this type of application, the Y-block allows an existing TAML Level 3 or 4 multilateral junction to be upgraded to a fully functional TAML Level 5 junction while simultaneously enabling control lines to be routed past the Y-block to support the intelligent completion located in the lateral leg of the junction. The control line bypass is useful in accommodating increasing complexity associated with many types of multilateral completions.

The Y-block also facilitates selective, through-tubing intervention via deployment of a suitable tool downhole into the Y-block. Additionally, the Y-block may be used to enable an operator to produce from the lateral bore and the main bore as either commingled production or pressure isolated production while enabling entry into either leg of the multilateral junction at will for further intervention work.

In some applications, the Y-block may incorporate an uphole facing seal bore which may be referred to as a seal bore diverter. The seal bore diverter allows the Y-block to be installed below a production packer as part of the same bottom hole assembly. A separate trip downhole may be used to tie-back the Y-block to the tubing completion by stinging into the seal bore diverter. This provides an operator with flexibility in performing additional work above the Y-block without having to run the completion at the same time as the installation of the TAML Level 5 multilateral junction. This design also provides the operator with the ability to use a standard wellhead versus a dual tubing wellhead by producing the lateral bore/lateral leg of the junction through the tubing annulus and producing the main bore/main leg of the junction through the internal passage of the tubing. However, the Y-block may be used in other applications and with multilateral junctions other than TAML Level 5 junctions.

Referring generally to FIG. 1, an embodiment of a system 20, e.g. a well completion system, is illustrated as deployed in a multilateral well 22 having, for example, a main bore leg 24 and a lateral bore leg 26. Depending on the application, well 22 may have multiple lateral bores 26. Additionally, system 20 may comprise a variety of well systems utilizing joined tubular components. In some embodiments, system 20 may comprise tubular components employed in non-well related applications, e.g. surface tubing applications. In the example illustrated, well system 20 comprises a Y-block 28 which is disposed in well 22 and has a pressure housing 30.

A lateral tubing string 32 is coupled to the pressure housing 30 of the Y-block 28 and extends into the lateral bore 26 of the multilateral well 22. Additionally, a main tubing string 34 is coupled to the pressure housing 30 of the Y-block 28 and extends downhole into the main bore 24. An uphole tubing string 36 also is coupled to the pressure housing 30 of the Y-block 28 and extends uphole toward the surface. Each of the lateral tubing string 32, the main tubing string 34, and the uphole tubing string 36 may be sealingly coupled, i.e. pressure sealed, with the pressure housing 30 of Y-block 28.

In a variety of applications, packers may be employed to seal off sections of the wellbore between the tubing strings and the surrounding wellbore wall. For example, a production packer 38 may be employed uphole, e.g. above, Y-block 28 and an additional packer 40 may be deployed downhole, e.g. below, Y-block 28. Additional packers may be deployed in the legs of the multilateral well 22. For example, a packer 42 may be deployed in lateral bore 26 and a corresponding packer 44 may be deployed in main bore 24 downhole from a junction 46 between lateral tubing string 32 and main tubing string 34. The Y-block 28 and the various tubular components and other components of lateral tubing string 32, main tubing string 34, and uphole tubing string 36 form a multilateral completion 48 deployed in multilateral well 22. As discussed above, the Y-block 28 may be employed in constructing junction 46 as a TAML Level 5 junction; however the Y-block 28 also may be employed in many other types of multilateral completions 48 with many types of junctions 46.

Figure 2:
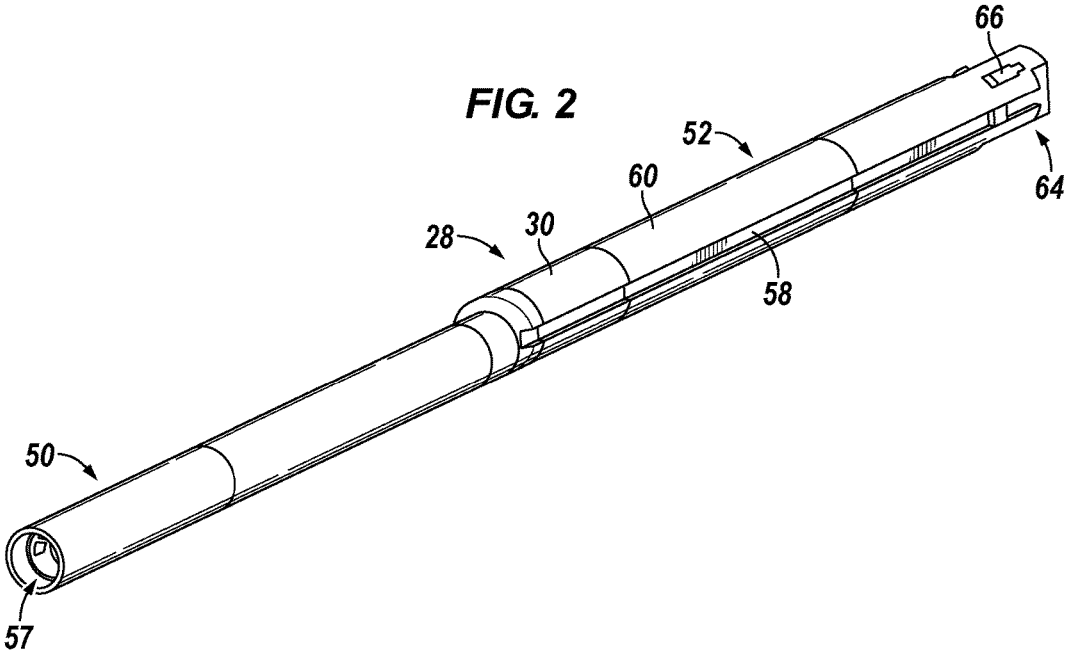
FIG. 2 is an orthogonal view of an example of a Y-block, according to an embodiment of the disclosure.
Figure 3:
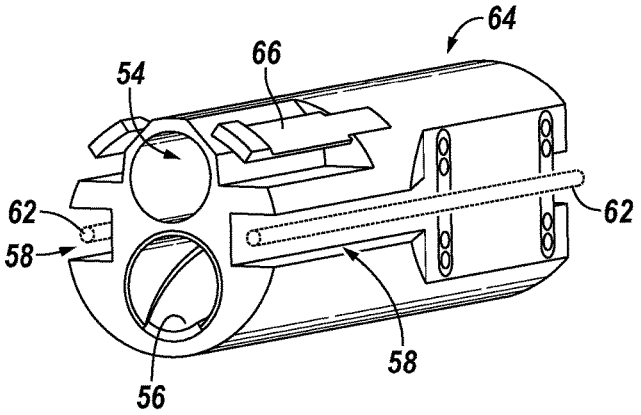
FIG. 3 is an orthogonal view of a portion of the Y-block illustrated in FIG. 2, according to an embodiment of the disclosure.

Referring generally to FIG. 2, an example of Y-block 28 is illustrated. In this example, the Y-block 28 comprises a single passage section 50 and a plural passage section 52. By way of example, the plural passage section 52 may comprise a pair of passages 54, 56, as illustrated in FIG. 3, and single passage section 50 may comprise an internal passage 57. In this example, passage 54 is fluidly coupled with lateral tubing string 32 to provide access to and receive flow from lateral bore 26. Similarly, passage 56 is fluidly coupled with main tubing string 34 to provide access to and receive flow from the main bore 24 which extends downhole from Y-block 28.

In the embodiment illustrated, Y-block 28 further comprises a recessed bypass slot 58 disposed along an exterior 60 of the Y-block. As illustrated best in FIG. 3, a plurality of the bypass slots 58 may be recessed radially inwardly along the exterior of the Y-block 28, e.g. along the exterior of pressure housing 30. The bypass slots 58 are designed to receive a control line or control lines 62 and allow the control lines 62 to be routed past the Y-tool 28 without creating splices, e.g. connections, between sections of the control lines. Splicing can provide weak points susceptible to corrosion, shorting, or other deleterious effects, and the bypass slots 58 enable running of the control lines 62 without splicing.

For example, splice-free control lines may be routed past Y-block 28 and into lateral bore 26 to provide control to the lateral tubing string 32. This capability enables use of intelligent completion systems along the lateral bore 26. Depending on the specific application, the control line or control lines 62 may comprise electrical cables or a variety of other control lines, including hydraulic control lines, optical fiber control lines, and other control lines. The control lines also may comprise hybrid control lines providing various combinations of electrical, hydraulic, optical, and/or other control lines.

The Y-block 28 also may comprise other features, such as coupling features for joining the Y-block 28 with other tubing string components. For example, the Y-block may comprise a connector end 64 having a collet 66 designed for connection with the next adjacent tubular component in multilateral completion 48. In some applications, the connector end 64 may be non-circular, e.g. oblong, to provide more room for bypass slots 58 and control lines 62.

Figure 4:
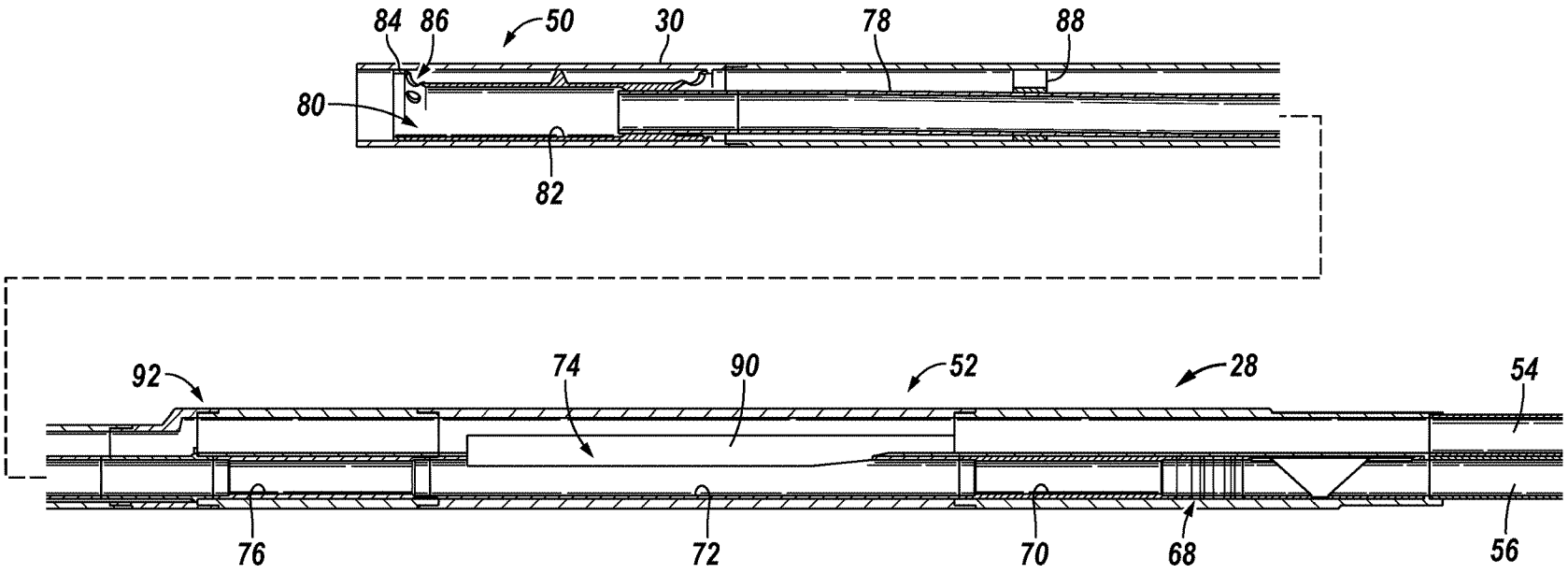
FIG. 4 is an axial cross-sectional view of an example of a Y-block used to connect tubulars in a multilateral completion system, according to an embodiment of the disclosure.

Referring generally to FIG. 4, a cross-sectional view of the Y-block 28 illustrates various internal components of the Y-block 28. In this example, the Y-block 28 comprises an orienting and latching system 68 designed to receive, orient and locate an intervention tool or other tool delivered downhole into passage 56 of the Y-block 28. The Y-block 28 also may comprise a lower seal bore 70 positioned to form a seal with an intervention tool string or other component. A window sub 72 having a window 74 may be located in pressure housing 30 and oriented such that window 74 enables communication between passage 54 and passage 56. In the example illustrated, an upper seal bore 76 is located on an opposite side of window sub 72 relative to lower seal bore 70.

Figure 5:
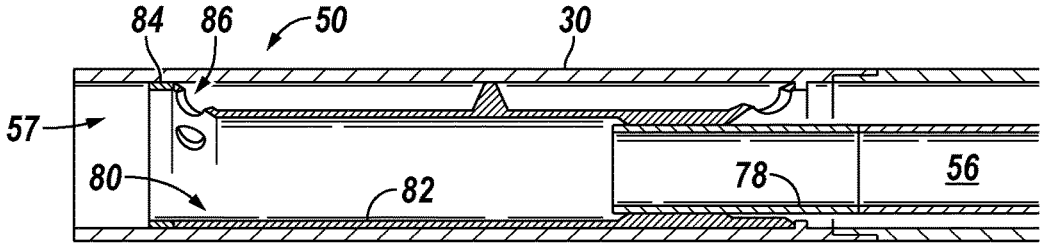
FIG. 5 is a cross-sectional view of a portion of the Y-block illustrated in FIG. 4, according to an embodiment of the disclosure.

Additionally, an internal tubing 78 may extend from seal bore 76 to a seal bore section 80 having a seal bore 82 and a flow diverter 84 with openings 86 through which fluid may flow from lateral passage 54, as further illustrated in FIG. 5. In some applications, the seal bores 70, 76 and 82 can be changed out to accommodate tools of different sizes, e.g. tools having different diameters. A centralizer 88 may be used to place and secure internal tubing 78 within passage section 50. In some applications, a filler structure 90 may be deployed along passage 54 adjacent window 74 to facilitate, for example, intervention operations in which an intervention tool is directed from passage 56, through window 74, and into passage 54 for intervention in lateral bore 26. The various internal components may be disposed along passageways 54, 56 within pressure housing 30.

Figure 6:
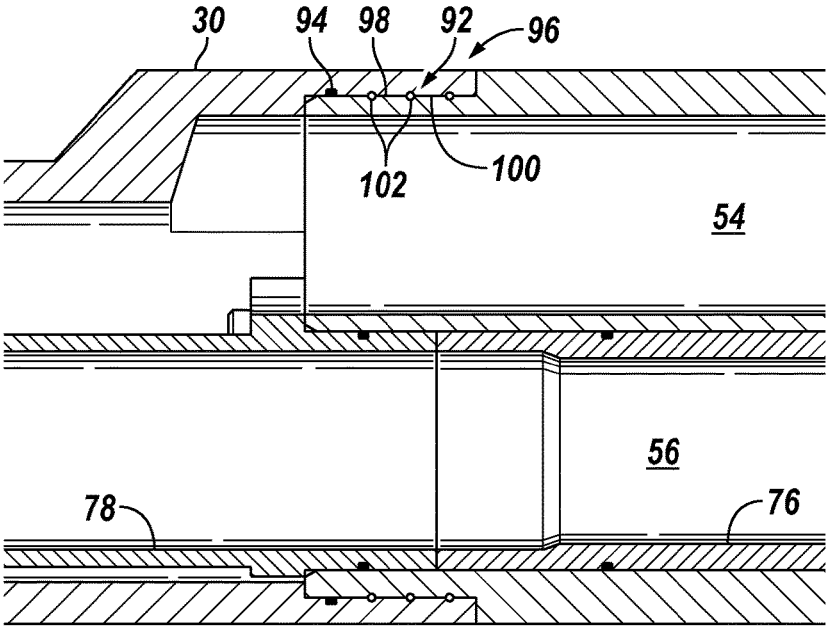
FIG. 6 is a cross-sectional view of another portion of the Y-block illustrated in FIG. 4, according to an embodiment of the disclosure.

As illustrated in FIG. 6, the internal components as well as the pressure housing 30 may comprise separable tubular components joined by suitable connectors, such as a connector system 92. In this example, connector system 92 comprises a seal system 94 and a locking mechanism 96 positioned between a first connector end 98 and a second connector end 100 of the connector system 92. Both the seal system 94 and the locking mechanism 96 may be positioned laterally, e.g. radially, between the connector ends 98 and 100. By way of example, the seal system 94 may comprise a seal and a backup ring or rings. In many applications, seal system 94 may utilize a standard O-ring style seal located in a groove formed in at least one of the connector ends 98 or 100.

The seal system 94 is designed to provide pressure integrity along the interior, e.g. along flow passages 54, 56, 57, of the tubular sections forming pressure housing 30. The locking mechanism 96 prevents inadvertent separation of the first connector end 98 from the second connector end 100. Although locking mechanism 96 may have a variety of forms, the illustrated embodiment utilizes a locking wire 102. In the specific example illustrated, locking mechanism 96 comprises a plurality of locking wires 102 which lock the housing tubulars linearly after linear insertion of first connector end 98 into second connector end 100. It should be noted that the connector ends 98, 100 may have a non-circular, e.g. oblong, shape designed to block relative rotation of the first connector end 98 with respect to the second connector end 100.

Figure 7:
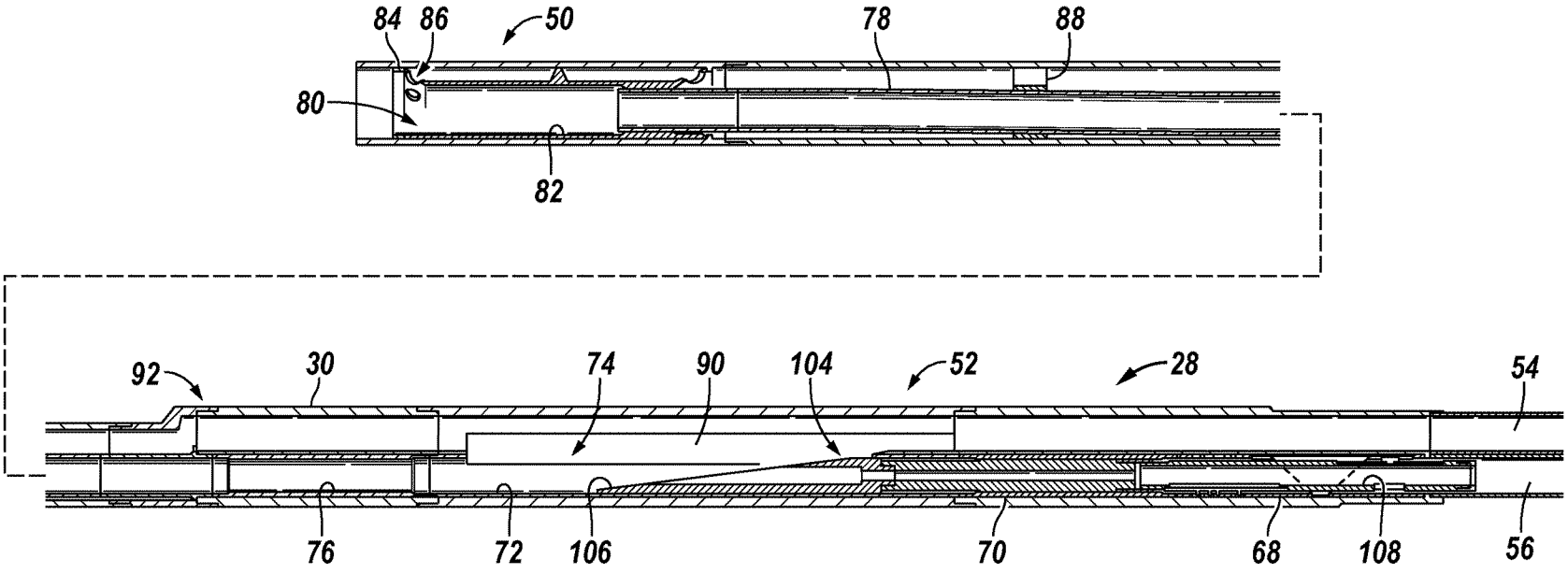
FIG. 7 is a cross-sectional view of an example of the Y-block into which a lateral deflector has been deployed, according to an embodiment of the disclosure.

Referring generally to FIG. 7, an embodiment of Y-block 28 is illustrated as having a tool 104 deployed in window sub 72. In this example, tool 104 comprises a lateral deflector 106 oriented to deflect an intervention tool string from passage 56, through window 74, and into passage 54. The lateral deflector 106 may be properly oriented and located by an orienting and locating mechanism 108 which works in cooperation with orienting and latching system 68 to orient the lateral deflector 106 rotationally and to properly position the lateral deflector 106 longitudinally. By way of example, the orienting and latching system 68 may comprise an alignment mules shoe having a helical profile positioned to engage and orient the mechanism 108 and thus the tool 104. In this embodiment, tool 104 is coupled with mechanism 108, and the combination is moved downhole into the Y-block 28 via a suitable conveyance, such as coil tubing or slick line.

Figure 8:
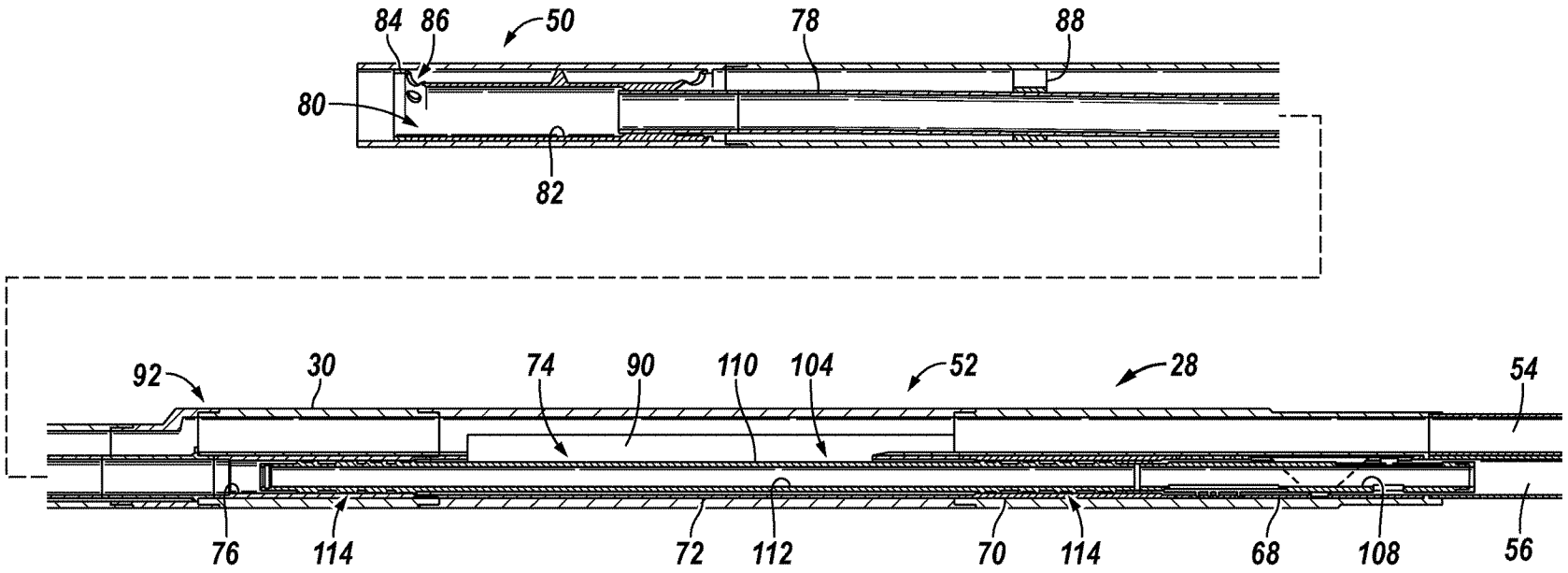
FIG. 8 is another cross-sectional view of an example of the Y-block into which an isolator has been deployed, according to an embodiment of the disclosure.

In FIG. 8, another example of tool 104 is illustrated. In this example, tool 104 comprises an isolator 110 which is designed to isolate passage 54 from passage 56 across window 74. For example, isolator 110 may comprise a solid tubing 112 attached to orienting and locating mechanism 108. When mechanism 108 is latched into orienting and latching system 68, the isolator 110 extends through window sub 72 and past window 74. The isolator 110 also may comprise seal sections 114 located above and below window 74 to pressure isolate passage 56 from passage 54. By way of example, isolator 110 may be used to guide an intervention tool string down into main bore 24. However, seal sections 114 enable pressure isolated production along separated passages 54 and 56. The isolator 110 and mechanism 108 may again be moved downhole into Y-block 28 via a suitable conveyance, such as coil tubing or slick line.

Figure 9:
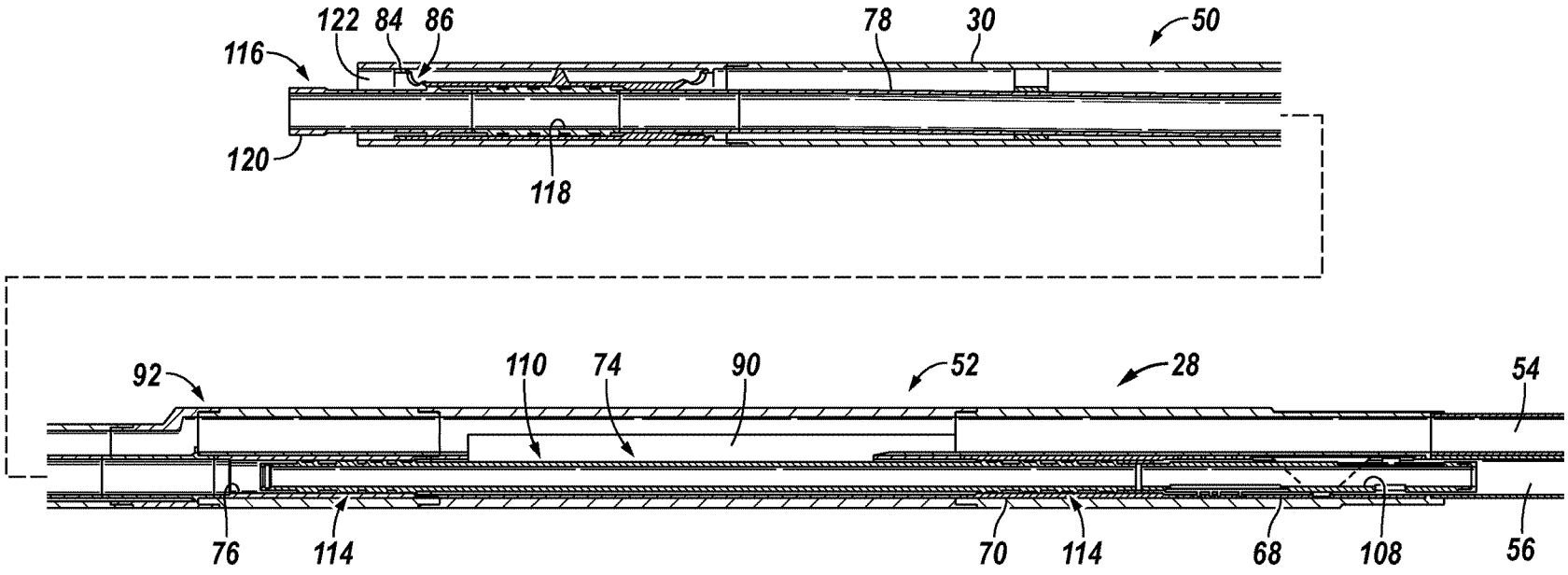
FIG. 9 is another cross-sectional view of an example of the Y-block into which an isolator and a seal stinger have been deployed, according to an embodiment of the disclosure.

To maintain separated fluid flows up through multilateral completion 48, a seal stinger 116 may be stabbed into the seal bore 82 of seal bore section 80, as illustrated in FIG. 9. By way of example, seal stinger 116 may comprise a seal section 118 which forms a pressure tight seal with seal bore 82. The seal stinger 116 also may comprise tubing 120 which extends upwardly from Y-block 28 within passage 57 and through multilateral completion 48 to a desired location, such as a surface location. Consequently, the seal stinger 116 (in cooperation with isolator 110) may be used to maintain an isolated flow of fluid to or from passage 56 and main bore 24. Similarly, an isolated flow of fluid to or from passage 54 and lateral bore 26 may be routed through openings 86 of flow diverter 84 and along an annulus 122 between seal stinger tubing 120 and the surrounding completion tubing of multilateral completion 48. It should be noted that well system 20 may be designed so that intervention tools, e.g. lateral deflector 106 and isolator 110, may be installed and removed through the tubing. Even when seal stinger 116 is inserted into seal bore 82, the isolator 110 and the lateral deflector 106 may be installed and removed without removing the tubing string of stinger 116. For example, after stabbing stinger 116 into seal bore 82, the isolator 110 can be removed and replaced with lateral deflector 106.

The configuration of Y-block 28 enables pressure isolation of two legs of a multilateral junction, e.g. junction 46. The Y-block 28 also enables performance of selective intervention operations on either leg of the multilateral junction 46 without removal of the Y-block 28. In embodiments illustrated herein, the pressure housing 30 of Y-block 28 forms the "Y" between an upper casing connection of multilateral completion 48 and the lower dual tubing connections which provide passages 54, 56 extending into each leg of the junction 46 for communication with tubing strings 32, 34. The pressure housing 30 also may be designed to provide internal orienting and latching system 68 as well as the external bypass slot or slots 58 for receiving control lines 62 which may be routed past the Y-block 28 without splicing.

Without installation of seal stinger 116, the pressure housing 30 enables commingled production from the main bore 24 and the lateral bore 26. However, the seal bore section 80 and seal bore diverter 84 enable selective use of the Y-block 28 to produce each leg of the junction 46 independently. For example, isolator 110 may be deployed in window sub 72 and seal stinger 116 may be stabbed into seal bore 82 to maintain isolated production from the main bore 24 and the lateral bore 26.

The Y-block 28 also facilitates easy intervention into either the main bore 24 or the lateral bore 26. To perform an intervention operation in the lateral bore 26/lateral tubing string 32, the lateral deflector 106 is simply installed in window sub 72. The lateral deflector 106 guides an intervention string, e.g. intervention bottom hole assemblies, laterally out into passage 54 and lateral tubing string 32. The orienting and latching system 68 may be used to orient and latch the lateral deflector 106 or isolator 110 into the Y-block 28.

In some applications, the orienting and latching system 68 (along with the orienting and locating mechanism 108) may utilize unique and differing latching systems at each junction 46 of a multilateral well. This allows each Y-block 28 to contain a selective profile for engagement with specific tools 104. By engaging specific tools at each junction 46, an operator is provided with selective access at each junction 46.

When the Y-block 28 is combined with multilateral completion 48 in an inverted orientation at each junction 46, the passages 54, 56 at the bottom of the Y-block extend and form a sealed connection with the lateral tubing string 32 and the main tubing string 34, respectively. By way of example, each leg of the junction 46 may be pressure isolated by installation of uphole tubing string 36, e.g. production tubing, into a packer seal bore of production packer 38. Upper pressure containment of the junction 46 is achieved by setting the production packer 38 in the parent casing. The Y-block pressure housing 30 contains the production pressure from each leg of the junction 46 and from the tubing strings 32, 34 in lateral bore 26 and main bore 24, respectively.

Depending on the application, the Y-block 28 may be utilized to facilitate communication, production, and/or intervention in a variety of tubing systems. Additionally, the Y-block and associated tubing structures may be constructed in several configurations. In multilateral well applications, for example, the Y-block may be utilized to facilitate lateral bore communication operations, intervention operations, production operations, and/or other well related operations. A single Y-block may be employed at a single junction or a plurality of Y-blocks may be employed at a plurality of junctions along the multilateral completion. Additionally, the tubular components forming each lateral bore tubing string and main bore tubing string may vary depending on the environment, wellbore structure, and specifics of a given application. The Y-block also may comprise a variety of internal components to provide sealing, intervention control, bore selection, intelligent completion control, tool orientation and location, and/or other functionality. The materials used to form the Y-block and the associated tubing strings also may vary depending on the specifics of a given application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a multilateral well, comprising:

a multilateral well completion deployed in a multilateral well, the multilateral well completion comprising:

a Y-block having a pressure housing and a recessed bypass slot disposed along an exterior of the Y-block, the Y-block further comprising an uphole facing seal bore diverter disposed in the pressure housing uphole from a window sub to enable use of the Y-block to selectively produce well fluid from at least one of a main bore and a lateral bore of the multilateral well;

a lateral tubing string sealingly coupled to the pressure housing and extending into the lateral bore of the multilateral well;

a main tubing string sealingly coupled to the pressure housing and extending downhole into the main bore of the multilateral well; and an uphole tubing string sealingly coupled to the pressure housing and extending uphole from the Y-block; and a control line positioned in the recessed bypass slot and routed into the lateral bore without splicing.

2. The system as recited in claim 1, wherein the Y-block comprises a plurality of recessed bypass slots and a plurality of control lines positioned in the plurality of recessed bypass slots, the plurality of control lines being routed into the lateral bore without splicing.

3. The system as recited in claim 1, wherein the recessed bypass slot is recessed into the pressure housing.

4. The system as recited in claim 1, wherein the pressure housing comprises an orienting and latching system.

5. The system as recited in claim 4, wherein the window sub comprises a window connecting flow from the lateral tubing string and the main tubing string.

6. The system as recited in claim 5, further comprising a tool deployed in the pressure housing and oriented via the orienting and latching system to enable selective intervention into the lateral bore or the main bore.

7. The system as recited in claim 6, wherein the tool comprises a lateral deflector.

8. The system as recited in claim 6, wherein the tool comprises an isolator.

9. The system as recited in claim 8, further comprising a seal stinger stabbed into the uphole facing seal bore diverter to enable separated production from the lateral bore and the main bore.

10. A method, comprising:

providing a Y-block with a pressure housing having a recessed bypass slot along an exterior of the pressure housing, the Y-block further comprising an uphole facing seal bore diverter disposed in the pressure housing uphole from a window sub to enable use of the Y-block to selectively produce well fluid from at least one of a main bore and a lateral bore of a multilateral well completion;

locating the Y-block in the multilateral well completion at a junction between a lateral bore tubing string and a main bore tubing string; and establishing control along the lateral bore tubing string by deploying a control line in the recessed bypass slot such that the control line extends past the Y-block and into a lateral bore without splicing.

11. The method as recited in claim 10, wherein establishing comprises deploying a plurality of control lines in a plurality of recessed bypass slots.

12. The method as recited in claim 10, wherein establishing comprises deploying an electrical control line.

13. The method as recited in claim 10, wherein establishing comprises deploying a hydraulic control line.

14. The method as recited in claim 10, further comprising deploying a tool into the Y-block to enable selective intervention into the lateral bore tubing string or the main bore tubing string.

15. The method as recited in claim 10, further comprising deploying a seal stinger into the Y-block to maintain separated production fluid flows from the lateral bore tubing string and the main bore tubing string.

16. A method, comprising:

coupling a Y-block with a lateral tubing string and a main tubing string, the Y-block comprising an uphole facing seal bore diverter disposed in a pressure housing uphole from a window sub to enable use of the Y-block to selectively produce well fluid from at least one of the main tubing string and the lateral tubing string of a multilateral well completion;

providing the Y-block with an internal orienting and latching system;

latching a tool within the Y-block via the orienting and latching mechanism; and using the tool to direct intervention through either the lateral tubing string or the main tubing string.

17. The method as recited in claim 16, further comprising: locating a bypass slot along an exterior of the Y-block; and routing a control line along the bypass slot and along the lateral tubing string.

18. The method as recited in claim 16, further comprising: constructing the Y-block with a pressure housing; locating a plurality of recessed bypass slots along an exterior of the pressure housing; and routing a plurality of control lines along the plurality of recessed bypass slots and along at least a portion of the lateral tubing string without splicing.

19. The method as recited in claim 18, further comprising locating the Y-block downhole in the multilateral well completion.

* * * * *